US007680446B2

(12) United States Patent
Shintani et al.

(10) Patent No.: US 7,680,446 B2
(45) Date of Patent: Mar. 16, 2010

(54) CLEANING DEVICE, PROCESS CARTRIDGE AND IMAGE FORMING APPARATUS

(75) Inventors: Takeshi Shintani, Kawasaki (JP); Kaoru Yoshino, Tokyo (JP); Satoshi Hatori, Yokohama (JP); Hiroshi Ono, Tokyo (JP); Akio Kosuge, Yokohama (JP); Takaya Muraishi, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 42 days.

(21) Appl. No.: 11/854,120

(22) Filed: Sep. 12, 2007

(65) Prior Publication Data

US 2008/0069614 A1 Mar. 20, 2008

(30) Foreign Application Priority Data

Sep. 19, 2006 (JP) ..... 2006-252049

(51) Int. Cl.
*G03G 21/00* (2006.01)

(52) U.S. Cl. ..... 399/346; 399/71; 399/167; 399/353; 399/350

(58) Field of Classification Search ..... 399/346, 399/71, 167, 349, 353, 350
See application file for complete search history.

(56) References Cited

U.S. PATENT DOCUMENTS

| | | | | |
|---|---|---|---|---|
| 5,676,479 | A * | 10/1997 | Yamaguchi et al. | 400/709 |
| 7,228,099 | B2 | 6/2007 | Shintani et al. | |
| 2003/0072580 | A1* | 4/2003 | Itoh et al. | 399/62 |
| 2004/0131381 | A1* | 7/2004 | Kawasumi et al. | 399/102 |
| 2005/0069339 | A1* | 3/2005 | Fiore et al. | 399/99 |
| 2005/0084271 | A1* | 4/2005 | Koike et al. | 399/12 |
| 2005/0152722 | A1* | 7/2005 | Tawada et al. | 399/346 |
| 2005/0169663 | A1 | 8/2005 | Shintani et al. | |
| 2006/0002736 | A1 | 1/2006 | Kikuchi et al. | |
| 2006/0039726 | A1* | 2/2006 | Shintani et al. | 399/346 |
| 2006/0045603 | A1 | 3/2006 | Hatori et al. | |
| 2006/0110184 | A1 | 5/2006 | Yoshino et al. | |
| 2006/0133834 | A1 | 6/2006 | Ono et al. | |
| 2007/0059035 | A1 | 3/2007 | Yoshino et al. | |

(Continued)

FOREIGN PATENT DOCUMENTS

JP 2000075752 A * 3/2000

(Continued)

OTHER PUBLICATIONS

U.S. Appl. No. 12/167,564, filed Jul. 3, 2008, Hatori, et al.

(Continued)

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

An image forming apparatus includes a photosensitive member, a charging member, an electrostatic latent image forming member, a developing member, a transferring member, and a cleaning device. The cleaning device includes a cleaning brush contacting with a photosensitive member to remove residual toner on the surface of the photosensitive member and a lubricant supplying brush contacting with the photosensitive member to supply a lubricant to the surface of the photosensitive member. The lubricant supplying brush is configured to change an amount of the lubricant supplied to the surface of the photosensitive member depending on a linear speed of the photosensitive member.

12 Claims, 4 Drawing Sheets

U.S. PATENT DOCUMENTS

| | | | | |
|---|---|---|---|---|
| 2007/0071525 | A1 | 3/2007 | Yoshino et al. | |
| 2007/0166087 | A1* | 7/2007 | Yamaguchi et al. | 399/346 |
| 2007/0183824 | A1* | 8/2007 | Suda et al. | 399/346 |

FOREIGN PATENT DOCUMENTS

| | | |
|---|---|---|
| JP | 2000-330443 | 11/2000 |
| JP | 2000-338819 | 12/2000 |
| JP | 2003-036011 | 2/2003 |
| JP | 2004-334092 | 11/2004 |
| JP | 2005-208325 | 8/2005 |
| JP | 2005-275086 | 10/2005 |

OTHER PUBLICATIONS

U.S. Appl. No. 11/857,070, filed Sep. 18, 2007, Kosuge.
U.S. Appl. No. 12/253,581, filed Oct. 17, 2008, Shintani et al.

* cited by examiner

CLEANING DEVICE, PROCESS CARTRIDGE AND IMAGE FORMING APPARATUS

CROSS-REFERENCE TO RELATED APPLICATIONS

The present application claims priority to Japanese patent application no. 2006-252049, filed in the Japanese Patent Office on Sep. 19, 2006, the disclosure of which is incorporated by reference herein in its entirety.

BACKGROUND OF THE INVENTION

1. Field of the Invention

The present invention relates to a cleaning device, an image forming apparatus, and a process cartridge that includes the cleaning device.

2. Discussion of Background

In an image forming apparatus, a toner image is formed on an image carrier such as a photosensitive member or an intermediate transfer member. The toner image formed on the image carrier is transferred to a receiving member such as a recording medium or other image carriers. A cleaning device removes residual toner that was not transferred to the transferred member.

Japan Laid-Open Patent Publication no. 2000-338819 shows a cleaning device including a brush that removes residual toner on a surface of a photosensitive member while supplying a lubricant to the surface of the photosensitive member. By supplying the lubricant to the surface of the photosensitive member, it is able to remove residual toner remaining on the surface of the photosensitive member easily, and it is able to prevent toner from adhering to the surface of the photosensitive member. In addition, it is able to decrease damage to the surface of the photosensitive member. The brush has a function of cleaning and scratching off residual toner on the surface of the photosensitive member, and a function of supplying the lubricant to the surface of the photosensitive member. The brush supplies the lubricant to the surface of the photosensitive member on which residual toner remains. In this cleaning device, the brush can change the supply of the lubricant when the amount of residual toner changes based on an image area rate or an efficiency of transferring.

Japan Laid-Open Patent Publication no. 2005-315912 shows a cleaning device including a cleaning brush to remove residual toner remaining on the surface of the photosensitive member and a lubricant supplying brush to supply a lubricant to the surface of the photosensitive member. The lubricant supplying brush supplies the lubricant to the surface of the photosensitive member after the cleaning brush removes residual toner remaining on the surface of the photosensitive member. Thus, this cleaning device can reduce the influence of the amount of residual toner remaining on the surface of the photosensitive member on the performance of supplying the lubricant.

The present inventors, however, found that this cleaning member can not maintain a suitable amount of lubricant applied to the surface of the photosensitive member when the rotation frequency of the photosensitive member changes.

SUMMARY OF THE INVENTION

Embodiments of the present invention can overcome one or more of the above-noted disadvantages.

An object of the present invention is to provide a cleaning device installed in an image forming apparatus including a cleaning brush contacting with a photosensitive member to remove residual toner on the surface of the photosensitive member and a lubricant supplying brush contacting with the photosensitive member to supply a lubricant to the surface of the photosensitive member, wherein the lubricant supplying brush changes an amount of the lubricant supplied to the surface of the photosensitive member depending on a linear speed of the photosensitive member.

Another object of the present invention is to provide a process cartridge detachably attached to an image forming apparatus including a photosensitive member configured to form an image on a surface thereof, a cleaning brush contacting with a photosensitive member to remove residual toner on the surface of the photosensitive member, a lubricant supplying brush contacting with the photosensitive member to supply a lubricant to the surface of the photosensitive member, wherein the lubricant supplying brush changes an amount of the lubricant supplied to the surface of the photosensitive member depending on to a linear speed of the photosensitive member.

A further object of the present invention is to provide an image forming apparatus including a photosensitive member configured to form an image on a surface thereof, a cleaning brush contacting with a photosensitive member to remove residual toner on the surface of the photosensitive member and a lubricant supplying brush contacting with the photosensitive member to supply a lubricant to the surface of the photosensitive member, wherein the lubricant supplying brush changes an amount of the lubricant supplied to the surface of the photosensitive member depending on a linear speed of the photosensitive member.

These and other objects, features and advantages of the present invention will become apparent upon consideration of the following description of the preferred embodiments of the present invention taken in conjunction with the accompanying drawings.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
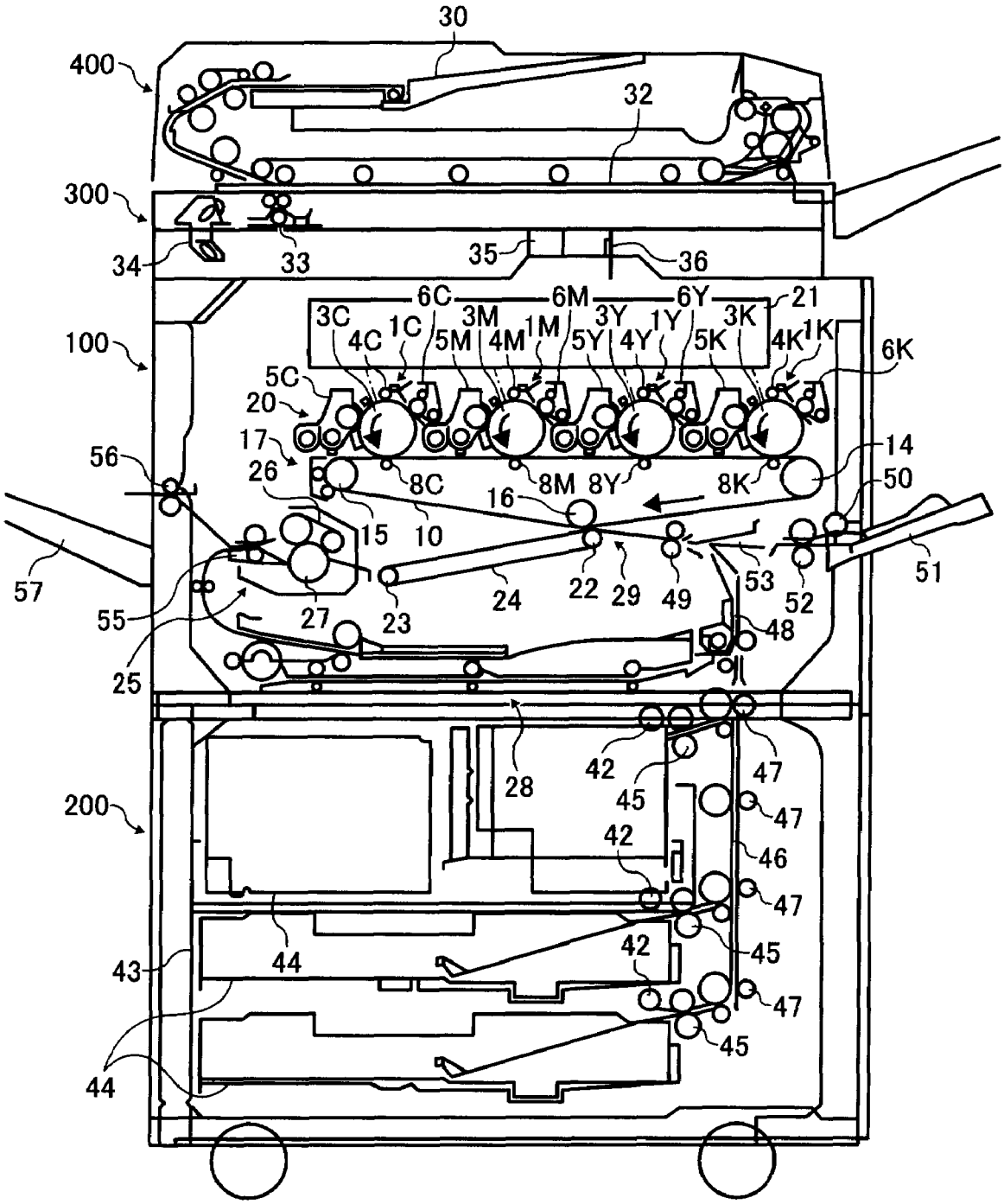
FIG. 1 is a schematic structure of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a structure of a tandem type color image forming apparatus is shown as example of an image forming apparatus according to an exemplary embodiment of the present invention.

FIG. 1 shows a schematic structure of an image forming apparatus, according to an embodiment of the present invention.

The image forming apparatus has a main body that includes an image forming section 100, a sheet feeding unit 200, an image scanning unit 300, and a document conveying unit 400. The image scanning unit 300 is located above the image forming section 100. The document conveying unit 400 including an automatic document feeder (ADF) is located above the image scanning unit 300. Moreover, the image forming apparatus includes a control unit (not shown) that controls the operations of various units of the image forming apparatus.

The image forming section 100 includes an intermediate transfer belt 10, serving as an intermediate transfer member. The intermediate transfer belt 10 is looped over a first roller 14, a second roller 15 and a third roller 16, and is driven clockwise.

Four photosensitive members 3K, 3Y, 3M and 3C each for black, yellow, magenta and cyan color toner images are arranged along a surface of the intermediate transfer belt 10. A charging device 4K, 4Y, 4M and 4C as a charging unit to charge the surface of the photosensitive member 3K, 3Y, 3M and 3C, and a developing device 5K, 5Y, 5M and 5C as a developing unit to develop the toner image on the surface of the photosensitive member 3K, 3Y, 3M and 3C are arranged around the photosensitive member 3K, 3Y, 3M and 3C, respectively. In addition, a cleaning device 6K, 6Y, 6M and 6C to remove residual toner remaining on the surface of the photosensitive member 3K, 3Y, 3M and 3C after a first transfer is arranged around the photosensitive member 3Y, 3M, 3C and 3K, respectively. An image forming device 1K, 1Y, 1M and 1C includes the photosensitive member 3K, 3Y, 3M and 3C, the developing device 5K, 5Y, 5M and 5C, the charging device 4K, 4Y, 4M and 4C and the cleaning device 6K, 6Y, 6M and 6C. Four image forming devices 1K, 1Y, 1M and 1C are arranged horizontally in a tandem image forming unit 20.

The intermediate transfer belt 10 includes an intermediate transfer belt cleaning device 17. The intermediate transfer belt cleaning device 17 removes residual toner remaining on the outer circumferential surface of the intermediate transfer belt 10 after secondary transferring at a secondary transferring nip positioned between the third roller 16 and the intermediate transfer belt 10.

An exposing unit 21 is positioned above the tandem image forming unit 20 in the image forming section 100.

First transferring rollers 8K, 8Y, 8M and 8C are arranged in an inside of the intermediate transfer belt 10 at an opposite side of the photosensitive members 3K, 3Y, 3M and 3C, respectively. The first transferring rollers 8K, 8Y, 8M and 8C are pressed against the photosensitive members 3K, 3Y, 3M and 3C, nipping the intermediate transferring belt 10 between the first transferring rollers 8K, 8Y, 8M and 8C and the photosensitive members 3K, 3Y, 3M and 3C to form a first transferring portion.

A secondary image transferring device 29 is arranged at an opposite side of the tandem image forming unit 20 across the intermediate transfer belt 10. The secondary transfer belt 24 is looped over a secondary image transferring roller 22 and a secondary transfer belt support roller 23. The secondary transfer belt 24 of the secondary image transferring device 29 is pressed against the third roller 16 nipping the intermediate transfer belt 10 between the secondary transfer belt 24 and the intermediate transfer belt 10 to form a secondary transferring nip as a secondary image transferring portion.

A fixing device 25 is positioned at one side of the secondary image transferring device 29 for fixing a toner image on a sheet or similar recording medium. The fixing device 25 includes an endless belt 26 and a press roller 27 pressed against the belt 26. The secondary image transferring device 29 additionally functions to convey the sheet to the fixing device 25 after image transfer. The secondary image transferring device 29 may, of course, be implemented as a charger that does not contact the intermediate transfer belt 10. With a charger, however, it is difficult to implement the sheet conveying function.

A turning device 28 is positioned below the secondary image transferring device 29 and the fixing device 25 in order to turn the sheet upside down in a duplex copy mode. The turning device 28 extends in parallel to the tandem image forming device 20. The turning device 28 turns the sheet upside down and again delivers it to the secondary image transferring position.

The image scanning unit 300 includes an image reading sensor 36 to read image information from documents positioned on an exposure glass 32 and send the read image information to the control unit.

Based on the image information that is received from the image scanning unit 300, the control unit controls a laser, an LED, or the like (not shown) positioned in an irradiating device 21 that irradiates a writing laser beam onto the photosensitive members 3K, 3Y, 3M, and 3C. Through this irradiation, latent electrostatic images are formed on the surfaces of the photosensitive members 3K, 3Y, 3M, and 3C, and the latent images are developed into respective toner images through an image developing process.

The sheet feeding unit 200 has media bank 43 into which a plurality of sheet feeding cassettes 44 are inserted; a plurality of sheet feeding rollers 42 that extract sheets of a recording medium (e.g., paper) from any one of the sheet feeding cassettes 44; a plurality of sheet separating rollers 45 that separate the sheets of the recording media and feed each sheet sequentially to a sheet feeding path 46. Sheet conveying rollers 47 feed the recording media to a sheet feeding path 48 of the image forming section 100.

In addition to the sheet feeding unit 200, manual sheet feeding is possible using a manual sheet feeding tray 51, that is located on the side of the image forming apparatus, into which recording media separated sheet-by-sheet by a sheet separating roller 52 are placed.

A resist roller 49 discharges, e.g., the recording media one sheet at a time, from any one of the sheet feeding cassettes 44 or the manual sheet feeding tray 51, and sends the recording media to a secondary image transferring nip positioned between an intermediate transfer belt 10 that is an intermediate transfer member, and the secondary image transferring device 29.

When taking copies of a color document, the color document is set on a document stand 30 of the document conveying unit 400, or the document conveying unit 400 is opened and the document is set on the exposure glass 32 of the image scanning unit 300. Then, upon operating a START key (not shown), the document that is set at the document conveying unit 400 is conveyed onto the exposure glass 32, and the image scanning unit 300 is activated. If, on the other hand, a document is manually placed on the exposure glass 32 and the START key is operated, the image scanning unit 300 is activated immediately to move a primary scanning member 33 and a secondary scanning member 34. Light is emitted from a light source at the primary scanning member 33, and then the light reflects off the surface of the document, and is further reflected towards the secondary scanning member 34. A mirror of the secondary scanning member 34 reflects the light through an imaging lens 35 onto an image reading sensor 36 that reads the image information.

The charging rollers 4K, 4Y, 4M and 4C uniformly charge a surface of the photosensitive members 3K, 3Y, 3M and 3C. The surface of the photosensitive members 3K, 3Y, 3M and 3C are irradiated by the exposing unit 21 with image data read by the image scanning unit 300 to form an electrostatic latent image on the photosensitive members 3K, 3Y, 3M and 3C, respectively. The electrostatic latent image on the photosensitive member 3K, 3Y, 3M and 3C is developed by the developing device 5K, 5Y, 5M and 5C to form a toner image on the surface of the photosensitive member 3K, 3Y, 3M and 3C, respectively.

At the same time, a drive motor, not shown, drives one of the first roller 14, the second roller 15 and the third roller 16 to thereby cause the transfer belt 10 to turn. The images respectively formed on the surface of the four photosensitive members 3K, 3Y, 3M and 3C are sequentially transferred to the intermediate transfer belt 10 one above the other in accordance with the rotation of the intermediate transfer belt 10, completing a full-color image on the outer circumferential surface of the intermediate transfer belt 10.

One of the sheet feeding rollers 42 of the sheet feeding unit 200 is selectively rotated, and recording media from one of the sheet feeding cassettes 44 is extracted and fed one-by-one, by the sheet separating roller 45, to the sheet feeding path 46. Each sheet of recording media is guided on the sheet feeding path 45 within the printer section 100 by sheet conveying rollers 47, and stops moving upon hitting the resist roller 49. Alternatively, the sheet feeding roller 50 rotates to extract recording media from the manual sheet feeding tray 51, the sheet separating roller 52 separates recording media one-by-one into the sheet feeding path 53, and the flow of the manually fed recording sheet is stopped by hitting against the resist roller 49. Then, the resist roller 49 rotates to align with the composite color image on the intermediate transfer belt 10, and recording media is fed into the secondary image transferring nip, which is a member formed by the contact of the intermediate transfer belt 10 and the secondary image transferring rollers 22.

The composite color image is transferred onto the recording media under the influence of an electrical field for image transfer and contact pressure in the nip. The secondary image transferring device 22 conveys the paper sheet carrying the toner image to the fixing device 25. The fixing device 25 fixes the toner image on the sheet with heat and pressure.

In a simplex copy mode, a path selector 55 steers the sheet toward an outlet roller pair 56, so that the paper sheet is driven out to a copy tray 57 via the roller pair 56. In a duplex copy mode, the path selector 55 steers the sheet into the turning device 28.

The turning device 28 turns the sheet upside down and again delivers it to the secondary image transfer position.

After a toner image has been formed on the reverse side of the same paper sheet, the outlet roller pair 54 drives the paper sheet to the copy tray 57.

After the secondary image transfer, the intermediate transfer belt cleaning device 17 removes the residual toner remaining on the outer circumferential surface of the intermediate transfer belt 10 to thereby prepare it for the next image formation.

Figure 2:
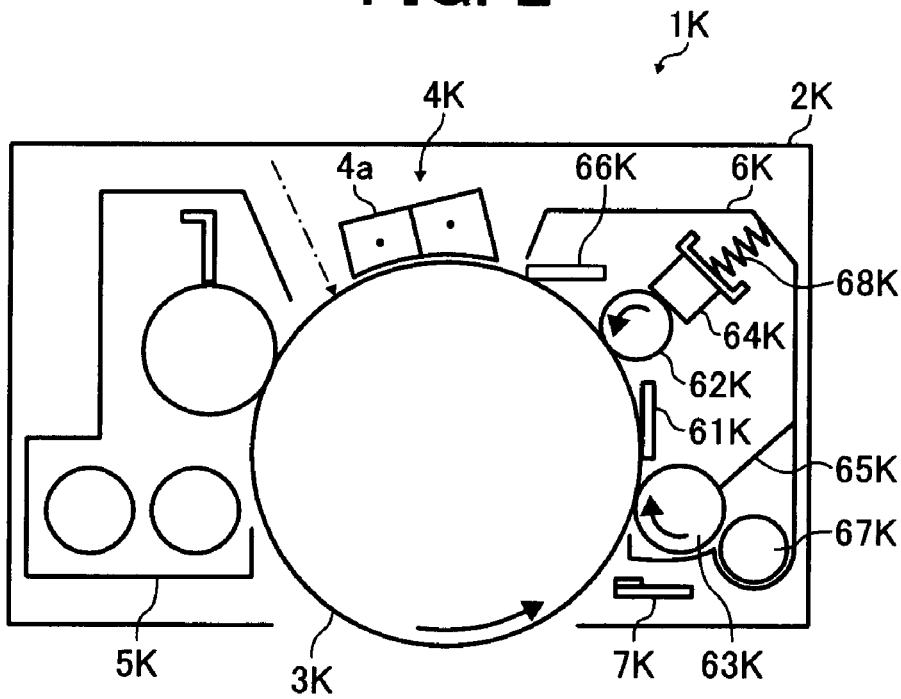
FIG. 2 is a schematic structure of an image forming device used for forming a black color image.
Figure 3:
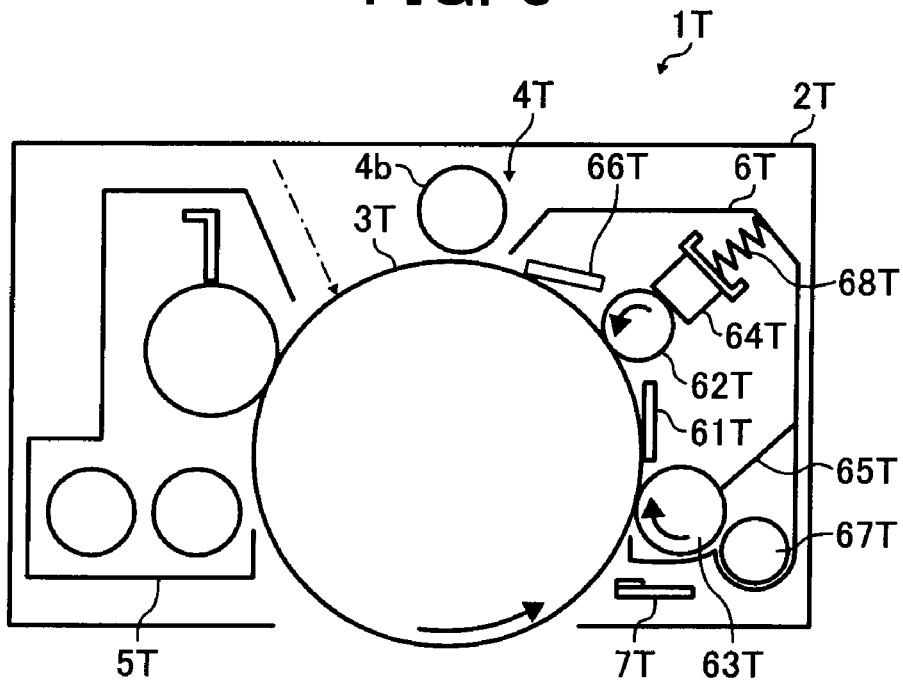
FIG. 3 is a schematic structure of an image forming device used for forming a yellow, magenta and cyan color image.

FIG. 2 shows an image forming device 1K used for forming a black color image, and FIG. 3 shows an image forming device 1T used for forming a cyan color image, a magenta color image and a yellow color image. As illustrated in FIG. 2 and FIG. 3, the image forming device 1K, 1T includes photosensitive member 3K, 3T and a process device such as a charging device 4K, 4T, developing device 5K, 5T and a lubricant supplying device 6K, 6T. The image forming device 1K, 1T including the photosensitive member 3K, 3T, the charging device 4K, 4T, the developing device 5K, 5T and the lubricant supplying device 6K, 6T within a unit case 2K, 2T is detachable from a body of the image forming apparatus as a process cartridge. In this embodiment, the image forming device 1K, 1T itself is replaceable, but it is possible that the photosensitive member 3K, 3T, the charging device 4K, 4T, the developing device 5K, 5T and the lubricant supplying device 6K, 6T themselves are replaceable.

The following describes a structure common to the image forming devices 1K, 1Y, 1M and 1C. As illustrated in FIG. 2 and FIG. 3, the cleaning device 6K, 6T of the image forming device 1K, 1T includes a lubricant body 64K, 64T, for example made of solid zinc stearate, as a lubricant and a lubricant supplying brush 62K, 62T supplying the lubricant to the surface of the photosensitive member 3K, 3T as a lubricant supplying member. The cleaning device 6K, 6T includes a precleaning discharge lump 7K, 7T, a cleaning brush 63K, 63T, a cleaning blade 61K, 61T, a lubricant supplying brush 62K, 62T and a lubricating blade 66K, 66T in the rotating direction of the photosensitive member 3K, 3T.

The cleaning blade 61K, 61T and the lubricating blade 66K, 66T may be made of rubber. The residual toner on the surface of the photosensitive member 3K, 3T is scraped with the cleaning brush 63K, 63T, removing the residual toner.

A brush cleaner 65K, 65T removes the residual toner adhered on the cleaning brush 63K, 63T. The residual toner removed by the brush cleaner 65K, 65T is conveyed out side of the cleaning device 6K, 6T by a conveying auger 67K, 67T.

The cleaning device 6K, 6T includes the cleaning brush 63K, 63T and the cleaning blade 61K, 61T remove the residual toner on the surface of the photosensitive member 3K, 3T. The lubricating blade 66K, 66T contacts the surface of the photosensitive member 3K, 3T in a direction trailing to the rotating direction of the photosensitive member 3K, 3T.

The lubricant body 64K, 64T mounted on a bracket is pressed against the lubricant supplying brush 62K, 62T by a pressuring spring 68K, 68T. The lubricant body 64K, 64T contacts the lubricant supplying brush 62K, 62T by applying a pressure of about 2 N to keep stable contact. The lubricant supplying brush 62K, 62T wipes the lubricant body 64K, 64T to supply the lubricant on the surface of the photosensitive member 3K, 3T.

The fibers of the lubricant supplying brush 62K, 62T are deformed by the photosensitive member 3K, 3T at an exit of a nip between the lubricant supplying brush 62K, 62T and the photosensitive member 3K, 3T. The lubricant supplying brush 62K, 62T rotates in a direction counter to the rotating direction of the photosensitive member 3K, 3T. Thus, powder of the lubricant body 64K, 64T wiped on the fibers of lubricant supplying brush 62K, 62T are supplied on the upstream surface of a contact portion of the photosensitive member 3K, 3T with the lubricant supplying brush 62K, 62T. The powder of the lubricant body 64K, 64T supplied to the surface of the photosensitive member 3K, 3T is deposited on the surface of the photosensitive member 3K, 3T, and moved to the contact portion by rotating of the photosensitive member 3K, 3T. Further, the lubricant supplying brush 62K, 62T rubs the powder of the lubricant body 64K, 64T on the surface of the photosensitive member 3K, 3T to form a thin layer of lubricant. According to this lubricant supplying system, an efficiency of supplying lubricant is improved.

The cleaning brush 63K, 63T rotates in the same direction as the rotating direction of the photosensitive member 3K, 3T, and rotates at a linear speed which is different from the linear speed of the photosensitive member 3K, 3T. However, the cleaning brush 63K, 63T may rotate in a direction counter to the photosensitive member 3K, 3T.

The cleaning blade 61K, 61T is fixed by a bracket (not shown) rotatably held.

The cleaning blade 61K, 61T contacts the surface of the photosensitive member 3K, 3T in a direction counter to the rotating direction of the photosensitive member 3K, 3T. The cleaning blade 61K, 61T is pressed by a pressuring spring (not shown) against the photosensitive member 3K, 3T to remove residual toner on the surface of the photosensitive member 3K, 3T.

The fibers of the cleaning brush 63K, 63T are deformed by the photosensitive member 3K, 3T at an exit of a nip between the cleaning brush 63K, 63T and the photosensitive member 3K, 3T. The cleaning brush 63K, 63T rotates in the same direction as the rotating direction of the photosensitive member 3K, 3T. Thus, toner removed by the cleaning brush 63K, 63T is supplied to the downstream surface of a contact portion of the photosensitive member 3K, 3T with the cleaning brush 63K, 63T. A part of the toner removed by the cleaning brush 63K, 63T is deposited on the surface of the photosensitive member 3K, 3T, and moved to a contact portion of the photosensitive member 3K, 3T with the cleaning blade 61K, 61T by rotating of the photosensitive member 3K, 3T.

The toner deposited on the surface of the photosensitive member 3K, 3T accumulates on the contact portion of the cleaning blade 61K, 61T and the photosensitive member 3K, 3T, forming a wedge. The accumulated toner at the edge of the cleaning blade 61K, 61T contacting the photosensitive member 3K, 3T shores up toner coming later, and a cleaning efficiency is improved.

The precleaning discharger 7K, 7T discharges the surface of the photosensitive member 3K, 3T passing the first transfer portion. The residual toners remaining the surface of the photosensitive member 3K, 3T are removed by the cleaning brush 63K, 63T and the cleaning blade 61K, 61T.

After removing the residual toner on the surface of the photosensitive member 3K, 3T, the lubricant supplying brush 62K, 62T supplies the surface of the photosensitive member 3K, 3T with the lubricant.

The lubricating blade 66K, 66T contacting the surface of the photosensitive member 3K, 3T in a direction counter to the rotating direction of the photosensitive member 3K, 3T forms a thin layer on the surface of the photosensitive member 3K, 3T.

The following describes differences between an image forming device 1K used for forming black images and an image forming device 1T used for forming color images.

As illustrated in FIG. 2, a charging device 4K of the image forming device 1K, which is frequently used by a user, includes a charger 4*a* including a charging wire and a grid.

The charger 4*a* applies a charging bias having a direct current component (refer to "DC charge type" hereinafter). On the other hand, a charging device 4T of the image forming device 1Y, 1M and 1C includes a charging roller 4*b*, which is a non-contact type charging member.

The charging roller 4*b* applies a charging bias having an alternate current component and a direct current component (refer to "AC+DC charge type" hereinafter).

As described above, there is a difference between the charging device 4K of the image forming device 1K and the charging device 4T of the image forming device 4K.

A proper amount of the lubricant applied to the surface of the photosensitive member 3 of an image forming device depends on the type of a charging system.

A proper amount of the lubricant applied to the surface of the photosensitive member in the case of the DC charge type differs from a proper amount of the lubricant applied to the surface of the photosensitive member in the case of the AC+DC charge type.

In the case of the AC+DC charge type, the lubricants on the surface of the photosensitive member are transformed by the alternate current component. The cleaning device removes the transformed lubricants on the surface of the photosensitive member, so the amount of the lubricant on the surface of the photosensitive member decreases.

Thus, additional lubricant must be supplied to make up for the removed transformed lubricant.

On the other hand, in the case of the DC charge type, the lubricants on the surface of the photosensitive member are not transformed by the alternate current component. Thus, the proper amount of the applied lubricant in the case of the DC charge type is less than the proper amount of the applied lubricant in the case of the AC+DC charge type.

In the case of using the contact type charging roller, the lubricant on the surface of the photosensitive member 3 possibly adheres on the surface of the contact type charging roller.

If the charging roller charges the surface of the photosensitive member with the adhering lubricant on the surface of the charging roller, the charging roller cannot fully charge the surface of the photosensitive member.

To prevent an adhering of the lubricant to the charging member, lubricant cannot be supplied excessively.

This specification further describes below a cleaning device according to an exemplary embodiment of the present invention.

In one exemplary embodiment of the present invention, a rotation frequency of the photosensitive member 3 is changed based on the kind of record medium used, such as transfer paper, and the setting of the image quality.

When the rotation frequency of the photosensitive member 3 is changed, a linear speed of the photosensitive member 3 changes.

When the linear speed of the photosensitive member 3 is changed, an amount of the lubricant supplied to the surface of the photosensitive member 3 is changed.

Furthermore, when an amount of the lubricant supplied to the surface of the photosensitive member 3 is maintained constantly, a suitable amount of the lubricant supplied to the surface of the photosensitive member 3 can be maintained.

The following describes different ways to change the amount of lubricant supplied to the surface of the photosensitive member.

(1) A hardness of the lubricant body, (2) A pressure of the pressuring spring 68 to press the lubricant body 64 against the lubricant supplying brush 62, (3) A characteristic feature of the lubricant supplying brush, such as a material of fiber and density, and (4) A linear speed of the lubricant supplying brush.

In the case of (1), it is difficult from the viewpoint of production.

In the case of (2), it is difficult to stably press the lubricant body to the lubricant supplying brush when a pressure of the pressuring spring is reduced too much.

In the case of the (3), it is difficult to adjust the amount of the lubricant applied to the surface of the photosensitive member 3 which depends on the characteristic feature of the lubricant supplying brush.

In the case of (4), when the rotation frequency of the lubricant supplying brush 62 is changed, a linear speed of the lubricant supplying brush 62 at a contact point with the surface of the photosensitive member 3 changes.

When the linear speed of the lubricant supplying brush 63 is changed, a number of bristles contacting the lubricant body 64 the lubricant supplying brush 62 changes.

Thus, an amount of the lubricant supplied to the surface of the photosensitive member 3 can be changed easily by changing the linear speed of the lubricant supplying brush.

EMBODIMENT 1

Figure 4:
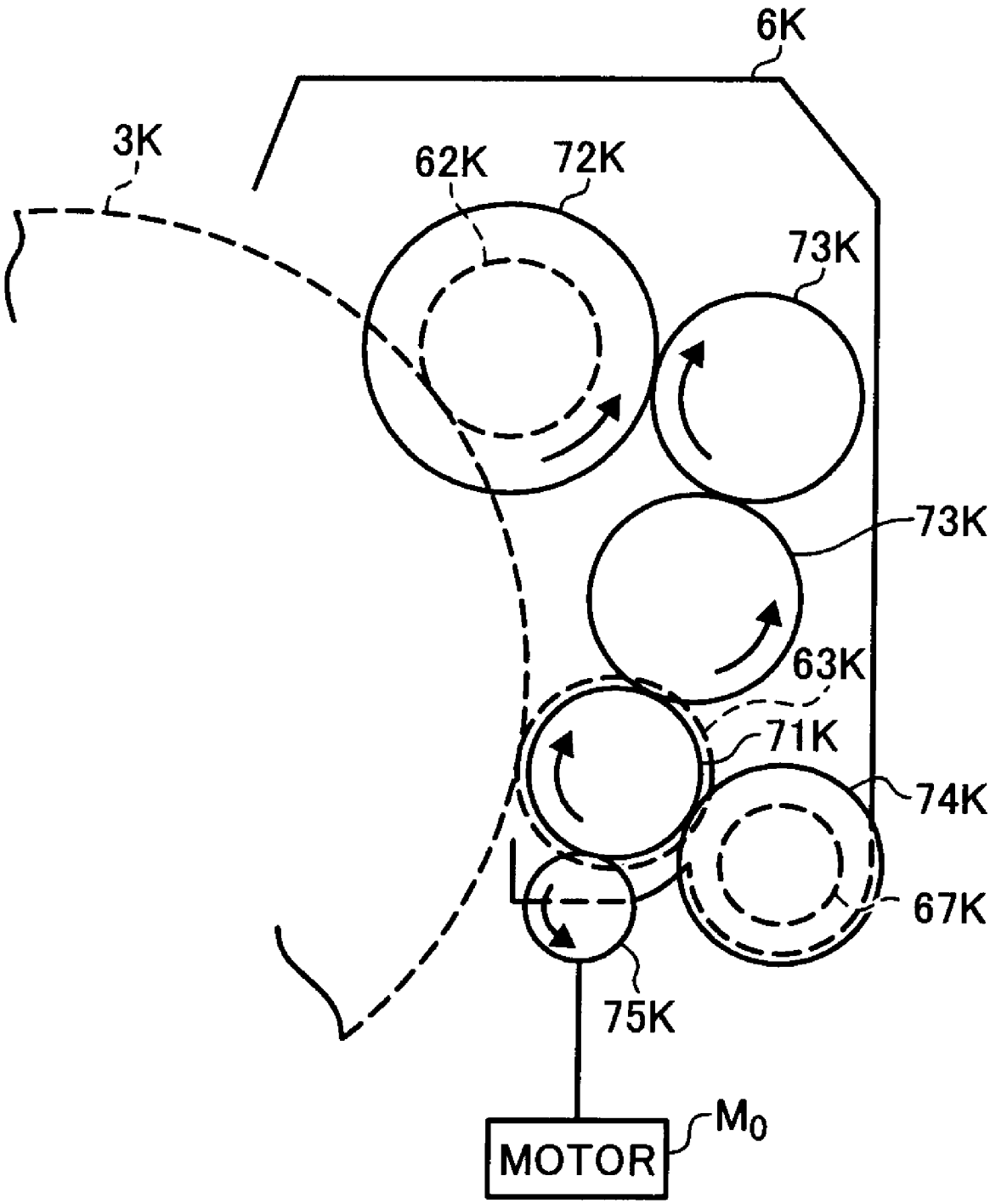
FIG. 4 is a schematic structure of a first embodiment of a driving force transmitting unit of the cleaning device provided in the image forming apparatus of FIG. 1.

FIG. 4 is a schematic structure of a first embodiment of a driving force transmitting unit of the cleaning device 6K included the image forming device 1K used for forming a black color image.

The driving force transmitting unit of the cleaning device 6K includes a driving gear 75K driven by one motor M0 as a driving source, a cleaning brush rotating gear 71K driving the cleaning brush 63K and a lubricant supplying brush rotating gear 72K driving the lubricant supplying brush 62K.

In addition, the driving force transmitting unit of the cleaning device 6K includes two idler gears 73K transmitting a driving force from the cleaning brush rotating gear 71K to the lubricant supplying brush rotating gear 72K and a conveying auger rotating gear 74K driving a conveying auger 67K.

The driving gear 75K rotates the cleaning brush rotating gear 71K, and the cleaning brush rotating gear 71K rotates the supplying rotating gear 72K going through the two idler gears 73K.

Compared with a radius of the cleaning brush rotating gear 71K, the idler gears 73K and the lubricant supplying brush rotating gear 72K, the radius of the supplying rotating gear 72K is the biggest, and the cleaning brush rotating gear 71K is the smallest.

Therefore a rotation frequency of the cleaning brush gear 71K is larger than a rotation frequency of the lubricant supplying brush gear 72K.

In the driving force transmitting unit, a linear speed of the cleaning brush 63K is faster than a linear speed of the lubricant supplying brush 62K.

The cleaning blade 61K contacts the upstream surface of a contact portion of the photosensitive member 3K with the lubricant supplying brush 62K in a direction counter to the rotating direction of the photosensitive member 3K.

Thus, the cleaning blade 61K prevents a decrease of a cleaning capability of the lubricant supplying brush 63K.

Therefore the cleaning capability of the cleaning brush 63K is maintained, and the amount of the lubricant supplied to the surface of the photosensitive member 3K is reduced.

In an image forming operation, a controller (not shown) changes the linear speed of the photosensitive member 3 based on the kind of record medium, such as transfer paper, and the setting of the image quality.

If the linear speed of the photosensitive member 3 is changed, an amount of the lubricant supplied to the surface of the photosensitive member 3 will be changed.

It is preferred that a ratio of the linear speed of the photosensitive member 3 to the lubricant supplying brush 63 and the cleaning brush 62 is maintained.

The ratio of the linear speed of the photosensitive member 3 to the lubricant supplying brush 63 and the cleaning brush 62 can be maintained by keeping a ratio of the rotation frequency of the photosensitive member 3 to the lubricant supplying brush 63 and the cleaning brush 62.

Table 1 shows the linear speed of the photosensitive member, the linear speed of the cleaning brush, the linear speed of the lubricant supplying brush and an amount of the lubricant applied to the surface of the photosensitive member 3.

| The linear speed of the photosensitive member [mm/sec] | The linear speed of the cleaning brush [mm/sec] | The linear speed of the lubricant supplying brush [mm/sec] | The amount of the lubricant applied to the surface of the photosensitive member [mg/km] |
|---|---|---|---|
| 300 | 360 | 200 | 110 |
| 150 | 180 | 100 | 110 |

The amount of the lubricant applied to the surface of the photosensitive member indicates an amount of the lubricant present on a portion of the surface of the photosensitive member per one kilometer of the photosensitive member.

Thus, the suitable amount of lubricant applied to the surface of the photosensitive member is constantly maintained even if the rotation frequency of the photosensitive member 3 changes.

The photosensitive member 3 may be driven by a driving source as with the cleaning brush 63.

The driving gear 75 rotates a photosensitive member rotating gear (not shown) driving the photosensitive member 3.

Thus, one motor can rotate the cleaning brush, the lubricant supplying brush and the photosensitive member. This reduces the number of motors needed as power sources, and lowers a cost of image forming device 1.

Furthermore, the ratio of the linear speed of the photosensitive member 3 to the cleaning brush 62 and the lubricant supplying brush 63 is constantly maintained even if the rotation frequency of the photosensitive member 3 changes.

EMBODIMENT 2

The preceding discussion of embodiment 1 has assumed a driving force transmitting unit having one motor MO which rotates the cleaning brush 63 and the supplying brush 62, but the present invention is not limited only to such driving force transmitting unit.

For example, a second embodiment can include a driving force transmitting unit having two motors which rotate the cleaning brush 63 and the supplying brush 62.

Figure 5:
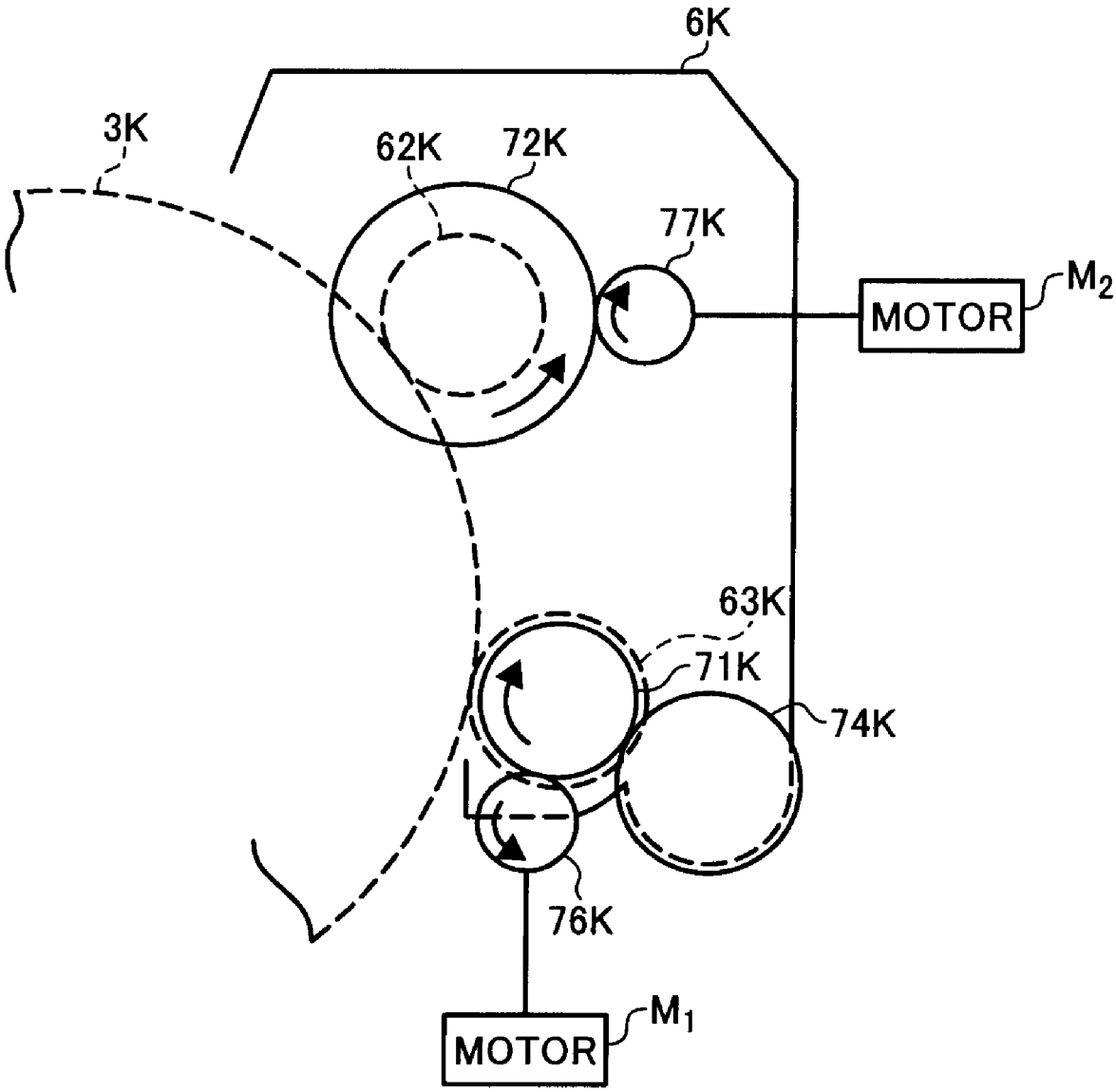
FIG. 5 is a schematic structure of a second embodiment of a driving force transmitting unit of the cleaning device provided in the image forming apparatus of FIG. 1.

FIG. 5 is a schematic structure of a driving force transmitting unit of the cleaning device 6K included the image forming device 1K used for forming a black color image.

The driving force transmitting unit of the cleaning device 6K includes a driving gear 76K driven by a motor Ml as a driving source, and the driving gear 76K rotates a cleaning brush rotating gear 71K driving the cleaning brush 63K.

In addition, the driving force transmitting unit of the cleaning device 6K includes a driving gear 77K driven by a motor M2 as a driving source, and the driving gear 77K rotates a lubricant supplying brush rotating gear 72K driving a lubricant supplying brush 62K.

The preceding discussion of embodiment 1 and embodiment 2 has assumed a driving force transmitting unit configured to drive the linear speed of the cleaning brush 63 faster than the linear speed of the lubricant supplying brush 62 by making the rotation frequency of the cleaning brush 63 faster than the rotation frequency of the lubricant supplying brush 62, but the present invention is not limited only to such driving force transmitting units.

For example, an embodiment of the present invention can include an driving force transmitting unit configured to drive the linear speed of the cleaning brush 63K faster than the linear speed of the lubricant supplying brush 62K by making the diameter of the cleaning brush 63K larger than the diameter of the lubricant supplying brush 62K.

In the cleaning device according to the above-described non-limiting exemplary embodiments, the suitable amount of lubricant applied to the surface of the photosensitive member is constantly maintained even if the rotation frequency of the photosensitive member 3 changes. Thus, the suitable amount of lubricant applied to the surface of the photosensitive member can be constantly maintained.

In the cleaning device according to the above-described non-limiting exemplary embodiments, a ratio of the linear speed of the photosensitive member 3 to the lubricant supplying brush 63 and the cleaning brush 62 is maintained by keeping a ratio of the rotation frequency of the photosensitive member 3 to the lubricant supplying brush 63 and the cleaning brush 62. Thus, the suitable amount of the lubricant applied to the surface of the photosensitive member and the cleaning capability can be maintained even if the rotation frequency of the photosensitive member 3 is changed.

In the cleaning device according to the above-described non-limiting exemplary embodiments, a rotation frequency of the cleaning brush 63 is larger than a rotation frequency of the lubricant supplying brush 62.

Thus, the linear speed of the cleaning brush 63 can be driven faster than the linear speed of the lubricant supplying brush 62.

In the cleaning device according to the above-described non-limiting exemplary embodiments, one motor M0 rotates the cleaning brush 63 and the lubricant supplying brush 62. Thus, the number of motors needed as power sources is reduced, and the cost of the cleaning device is reduced.

In the cleaning device according to the above-described non-limiting exemplary embodiments, the motor M0 rotates the cleaning brush rotating gear 71. Two idler gears 73 transmit a driving force from the cleaning brush rotating gear 71 to the lubricant supplying brush rotating gear 72. The rotation frequency of the cleaning brush rotating gear 71 is larger than the rotation frequency of the lubricant supplying brush rotating gear 72.

In the cleaning device according to the above-described non-limiting exemplary embodiments, the radius of the idler gear 73 is bigger than the radius of the cleaning brush rotating gear 71, and the radius of the idler gear 72 is smaller than the radius of the lubricant supplying brush 72. Thus, the rotation frequency can be decreased gradually.

When a power source of the cleaning brush 63 or the lubricant supplying brush 62 rotates the photosensitive member 3, the number of motors needed as power sources is reduced, and the cost of the cleaning device is reduced.

In the cleaning device according to the above-described non-limiting exemplary embodiments, the cleaning blade 61 contacts the upstream surface of a contact portion of the photosensitive member 3 with the lubricant supplying brush 62 in a direction counter to the rotating direction of the photosensitive member 3.

Thus, the cleaning blade 61 can prevent a decrease of a cleaning capability of the lubricant supplying brush 63.

Namely, the cleaning capability of the cleaning brush 63 is maintained, and the amount of the lubricant supplied to the surface of the photosensitive member is reduced.

In the cleaning device according to the above-described non-limiting exemplary embodiments, the lubricating blade 66 contacts the surface of the photosensitive member 3 in a direction trailing to the rotating direction of the photosensitive member 3.

Thus, the lubricating blade 66 can form a thin layer of lubricant on the surface of the photosensitive member 3.

In the cleaning device according to the above-described non-limiting exemplary embodiments, the lubricant supplying brush 62 rotates in a direction counter to the rotating direction of the photosensitive member 3. Thus, the efficiency of applying lubricant can be improved.

When the image forming device 1 is detachable from a body of the image forming apparatus as a process cartridge, the tandem image forming apparatus can provide easier maintenance.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claim as new and desired to be secured by Letters Patent of the United State is:

1. A cleaning device installed in an image forming apparatus comprising:

a cleaning brush configured to contact a photosensitive member to remove residual toner on the surface of the photosensitive member; and a lubricant supplying brush configured to contact the photosensitive member to supply a lubricant to the surface of the photosensitive member;

wherein a linear speed of the lubricant supplying brush is changed such that a ratio of a linear speed of the photosensitive member to the linear speed of the lubricant supplying brush is maintained when the linear speed of the photosensitive member is changed, and a linear speed of the cleaning brush is changed such that a ratio of the linear speed of the photosensitive member to the linear speed of the cleaning brush is maintained when the linear speed of the photosensitive member is changed.

2. The cleaning device according to claim 1, wherein:

a linear speed of the cleaning brush is configured faster than a linear speed of the lubricant supplying brush.

3. The cleaning device according to claim 1, further comprising:

a driving source configured to rotate both the cleaning brush and the lubricant supplying brush.

4. The cleaning device according to claim 1, further comprising:

a driving gear configured to be driven by a motor as a driving source;

a cleaning brush rotating gear configured to drive the cleaning brush; and a lubricant supplying brush rotating gear configured to drive the lubricant supplying brush.

5. The cleaning device according to claim 1, further comprising:

a first driving source configured to rotate the cleaning brush; and a second driving source configured to rotate the lubricant supplying brush.

6. The cleaning device according to claim 1, further comprising:

a power source of either the cleaning brush or the lubricant supplying brush configured to rotate the photosensitive member.

7. The cleaning device according to claim 1, further comprising:

a cleaning blade arranged between the cleaning brush and the lubricant supplying brush in the rotating direction of the photosensitive member.

8. The cleaning device according to claim 7, wherein:

the cleaning blade is configured to contact the surface of the photosensitive member in a direction counter to the rotating direction of the photosensitive member.

9. The cleaning device according to claim 1, further comprising:

a lubricating blade arranged downstream of the lubricant supplying brush in the rotating direction of the photosensitive member.

10. The cleaning device according to claim 9, wherein:

the lubricating blade is configured to contact the surface of the photosensitive member in a direction trailing to the rotating direction of the photosensitive member.

11. The cleaning device according to claim 1, wherein:

the lubricant supplying brush is configured to rotate in a direction counter to the rotating direction of the photosensitive member.

12. The cleaning device according to claim 1, wherein:

the cleaning brush is configured to rotate in a same direction as the rotating direction of the photosensitive member.

* * * * *